US006244254B1

(12) United States Patent
Chen

(10) Patent No.: US 6,244,254 B1
(45) Date of Patent: Jun. 12, 2001

(54) POWER ACTIVATING DEVICE

(76) Inventor: Tung-Sen Chen, No. 7-3, Alley 7, Lane 128, Sec. 3, Shiow-Laang Rd., Jong-Her City, Taipei County (TW)

( * ) Notice: Subject to any disclaimer, the term of this patent is extended or adjusted under 35 U.S.C. 154(b) by 0 days.

(21) Appl. No.: 09/401,270

(22) Filed: Sep. 23, 1999

(51) Int. Cl.[7] ..... F02M 33/00
(52) U.S. Cl. ..... 123/536; 123/539
(58) Field of Search ..... 123/536–539

(56) References Cited

U.S. PATENT DOCUMENTS 4,754,742 * 7/1988 Young ..... 123/539
5,010,869 * 4/1991 Lee ..... 123/539
5,044,346 * 9/1991 Tada et al. ..... 123/536
5,692,481 * 12/1997 Miller ..... 123/539

* cited by examiner

*Primary Examiner*—Marguerite McMahon
(74) *Attorney, Agent, or Firm*—Bacon & Thomas PLLC

(57) ABSTRACT

A power activating device with several energy emitters provided in the air passing throughway of the fuel inlet system of an internal combustion engine. The energy emitters can emit preset energy (e.g., far infrared rays, electromagnetic field). Parallel guide holes extending therethrough are formed in the energy emitter in order to smooth the air flow and to enlarge the contact surface area so that the energy given off by the energy emitters can exert a full effect on the air running therethrough and the cluster of water molecules in the air can be made smaller and smaller in order to increase the contact surface area of the compressed air and improve the nebulization of the fuel, achieve complete combustion efficiency, reduce air pollution and increase horse power, torque, and acceleration of the vehicle.

14 Claims, 9 Drawing Sheets

POWER ACTIVATING DEVICE

BACKGROUND OF THE INVENTION

1. Field of the Invention

The present invention relates to a green horse-power activating device, and more particularly to devices with several energy emitters provided in the air passing through by way of an internal combustion engine (for e.g. vehicle engine and mechanical engine), wherein the energy emitters themselves can emit the present energy (e.g. far-infrared ray, electromagnetic field by influencing the compressed air passing through so that the cluster of water molecules in the moisture within air is affected by external forces (magnetic or electric forces, supersonic wave or infrared rays, etc.). The water molecule cluster in the air can be made smaller and the greater nebulization of the fuel increases the contact surface are between the compressed air and the fuel in order to achieve a complete combustion of fuel and to reduce the air pollution, to increase the horse power, torsion and acceleration force.

2. Description of the Prior Art

There are a lot of disclosures of the prior art in the field about the chemical and physical properties of fluid (e.g. fuel oil, water etc.) passing through a pre-arranged guide tube that can be altered by the line of magnetic force in order to enhance the combustion efficiency and to increase its activity. Their principle lies in that the alkyl group fuel is a formal simple dydrogenid having a cage structure and being prone to have chain polymerization with another elements to form pseudo-compounds. When these compounds are affected by an electrical field or a magnetic field, it's easy for them to produce an obvious chain effect with oxygen. In other words, this utilizes the magnetic cutting effect to divide the fuel particles of the hydrocarbon into smaller monoparticles while the irregular colloid in the fuel is cut for decomposition so that the fuel can be made in fine dispersion and atomization to facilitate absorption of oxygen and to bind therewith. Accordingly, the hydrocarbon particles have more tolerance to oxygen and the fuel can be burnt more completely to enhance the combustion efficiency.

However, the above-mentioned magnetic effect is absolutely dependent on properties, cost and processing of material, the intensity of the magnetic force of the magnet, the separating distance between magnets having effect on the fluid guide tube and the polar arrangement. Thus, the magnetic force effect in accordance with the prior art utilizes magnet pieces which are disposed around the fluid guide tube of various arrangement structure in order to obtain the best direction and position to have effect on the fluid inside. However, the fluid inside of the above-mentioned guide tubes is fuel oil, water etc. with greater density. When they flow with a high speed, the magnetic force effect is very limited. In addition, the magnetic polarity direction and position should be considered for the locating position of the magnet.

SUMMARY OF THE INVENTION

It is a main object of the present invention to provide a green horse-power activating device with several energy emitters provided in the air passing through by way of the fuel inlet system of the internal combustion engine, wherein the energy emitters themselves can emit preset energy (e.g. far infrared rays, electromagnetic field), and a plurality of parallel extending through guide holes are formed in the energy emitter in order to smooth the air flow and to enlarge the contact surface area so that the energy given off by the energy emitter can exert a full effect on the air running therethrough and the cluster of water molecular in the air can become smaller and smaller to increase the contact surface area of the air and the fuel in order to achieve complete combustion efficiency and to less the air pollution.

BRIEF DESCRIPTION OF THE DRAWINGS

The drawings disclose illustrative a number of embodiments of the present invention which serve to exemplify the various advantages and objects hereof, and are as follows.

DETAILED DESCRIPTION OF THE PREFERRED EMBODIMENT

Figure 1:
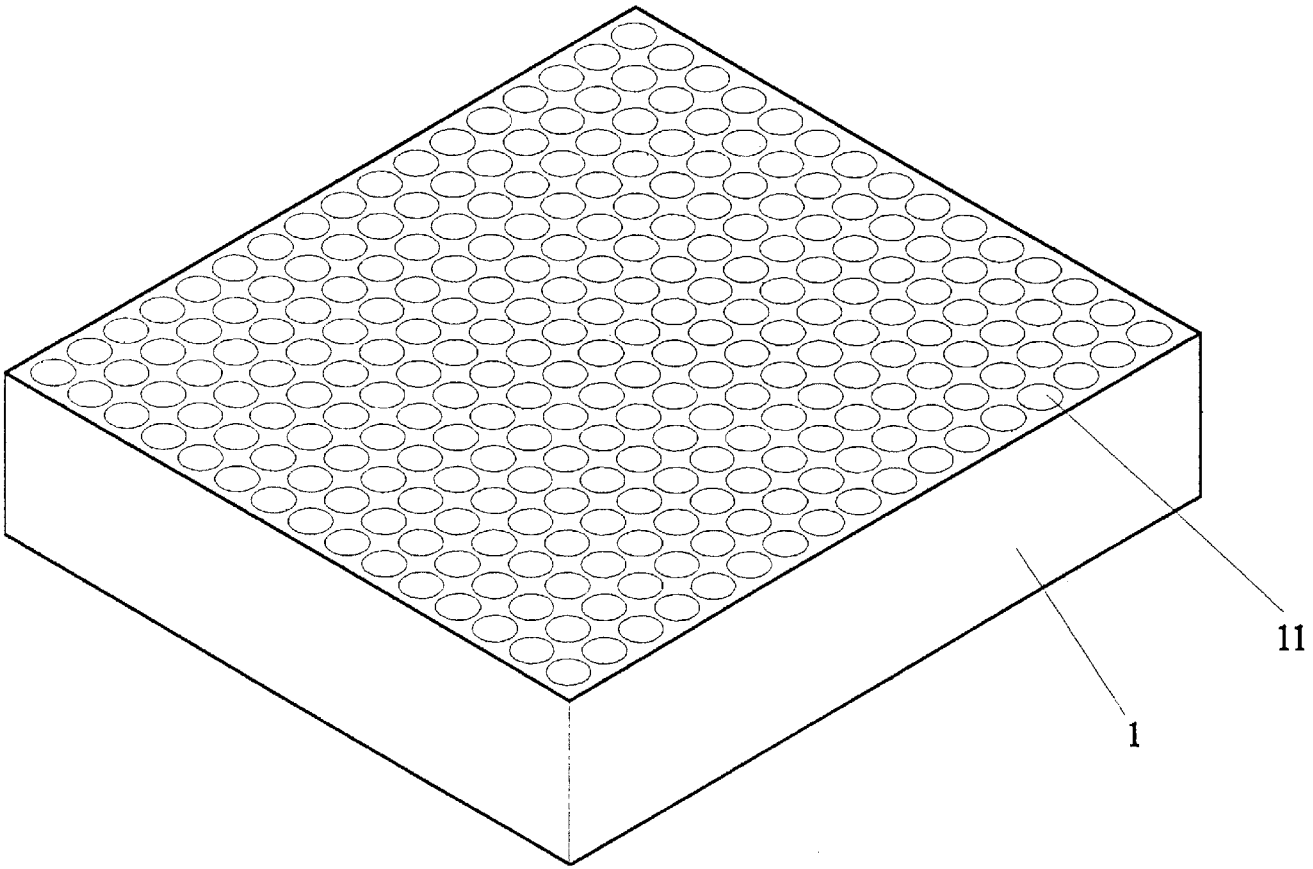
FIG. 1 is a perspective view of a preferred embodiment of the energy emitter in accordance with the present invention.
Figure 2:
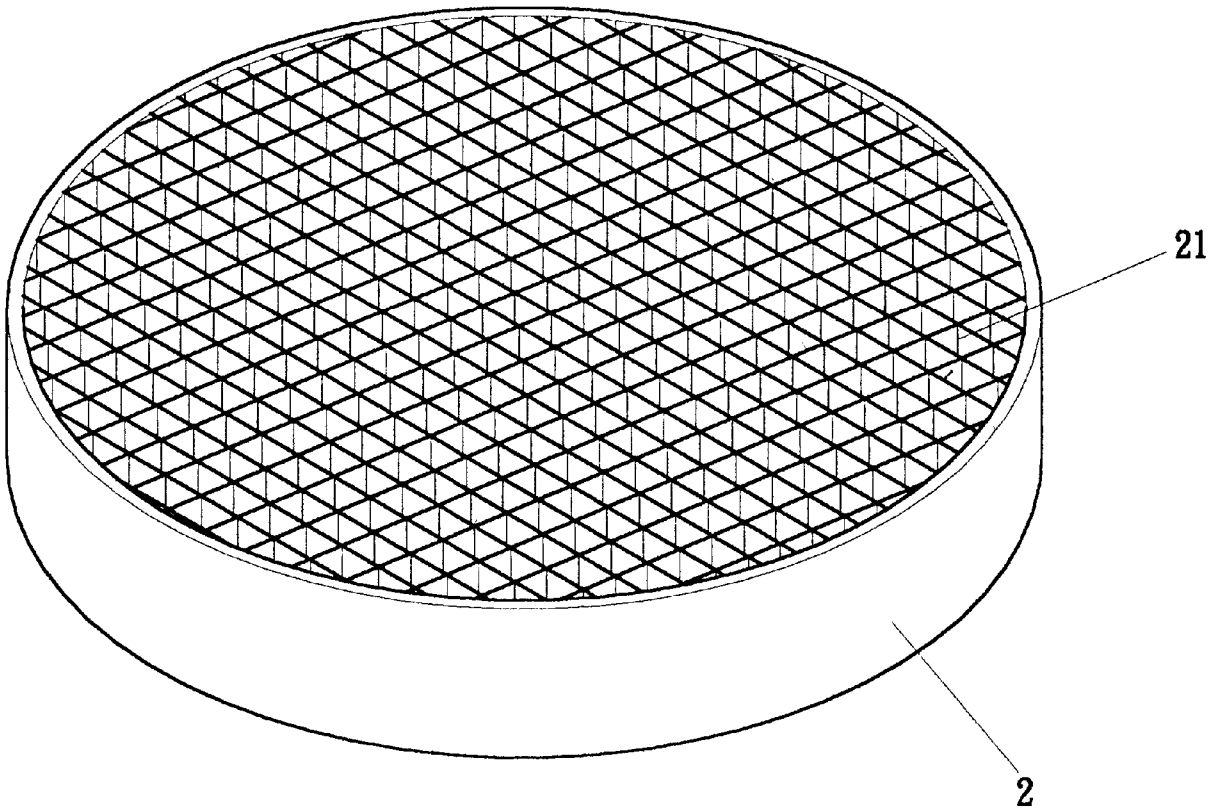
FIG. 2 is a perspective view of another preferred embodiment of the energy emitter in accordance with the present invention.

FIGS. 1 and 2 show preferred embodiments of the energy emitter in accordance with the present invention. As shown in FIG. 2, the energy emitter 1, 2 can be formed in various (e.g. square-shaped, circular, pole-shaped or another) shapes and thickness in accordance with the different application sites and desired effects. A plurality of parallel extending guide holes 11, 12 are provided in the energy emitter 1, 2 which can be in various forms (e.g. dense-circular, square-shaped, triangular) and mainly made of at least one of the ceramic, metallic and polymer material mixed in accordance with different (or preset) proportion thereof. Accordingly, the energy emitter 1, 2 having compound material structure and far infrared ray and/or electromagnetic energy emission function can be formed. Moreover, the energy emitter 1, 2 made of ceramic or metallic material can produce electromagnetic energy.

Figure 3A:
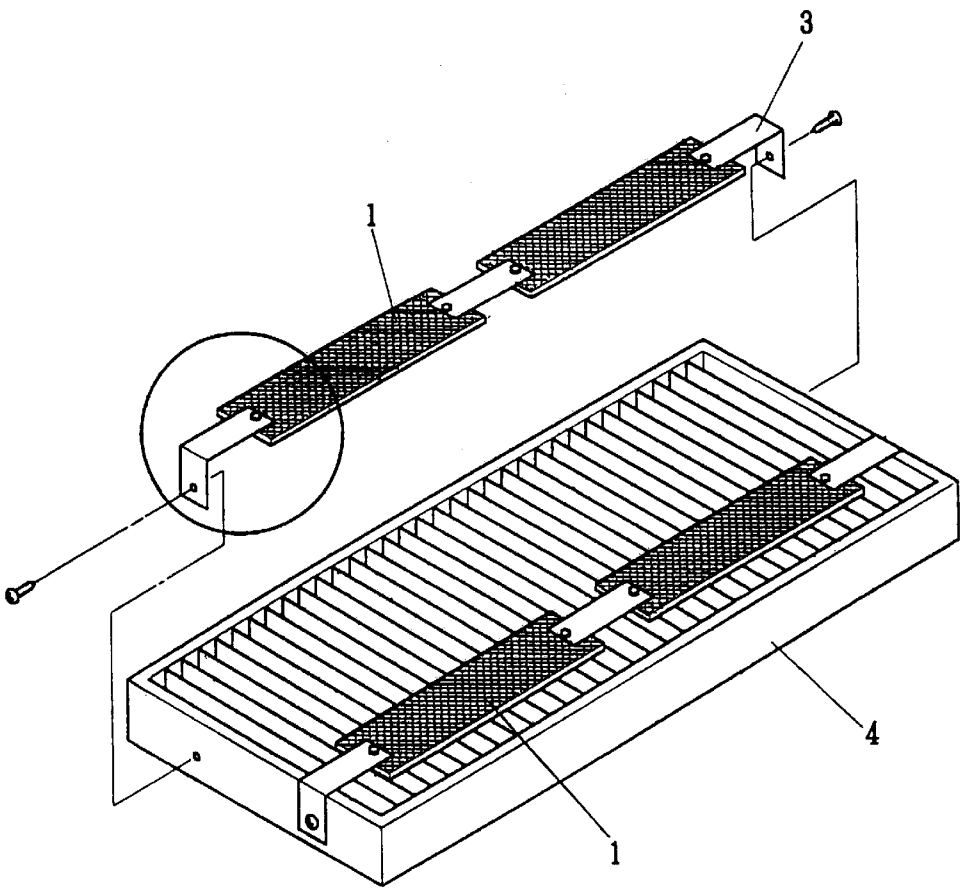
FIG. 3(A) is a perspective view of the energy emitter cooperating with a flexible locating member in accordance with the present invention.
Figure 3B:
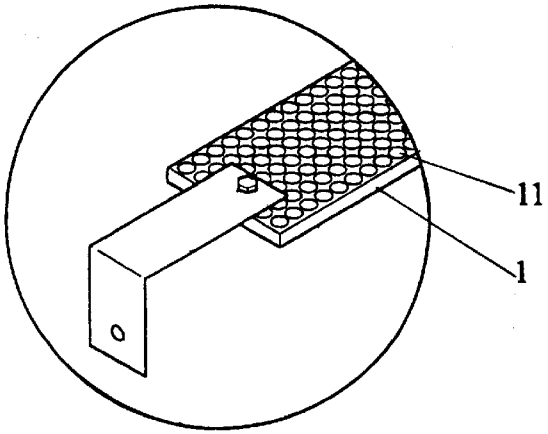
FIG. 3(B) is an enlarged view of the circle of FIG. 3(A)
Figure 4:
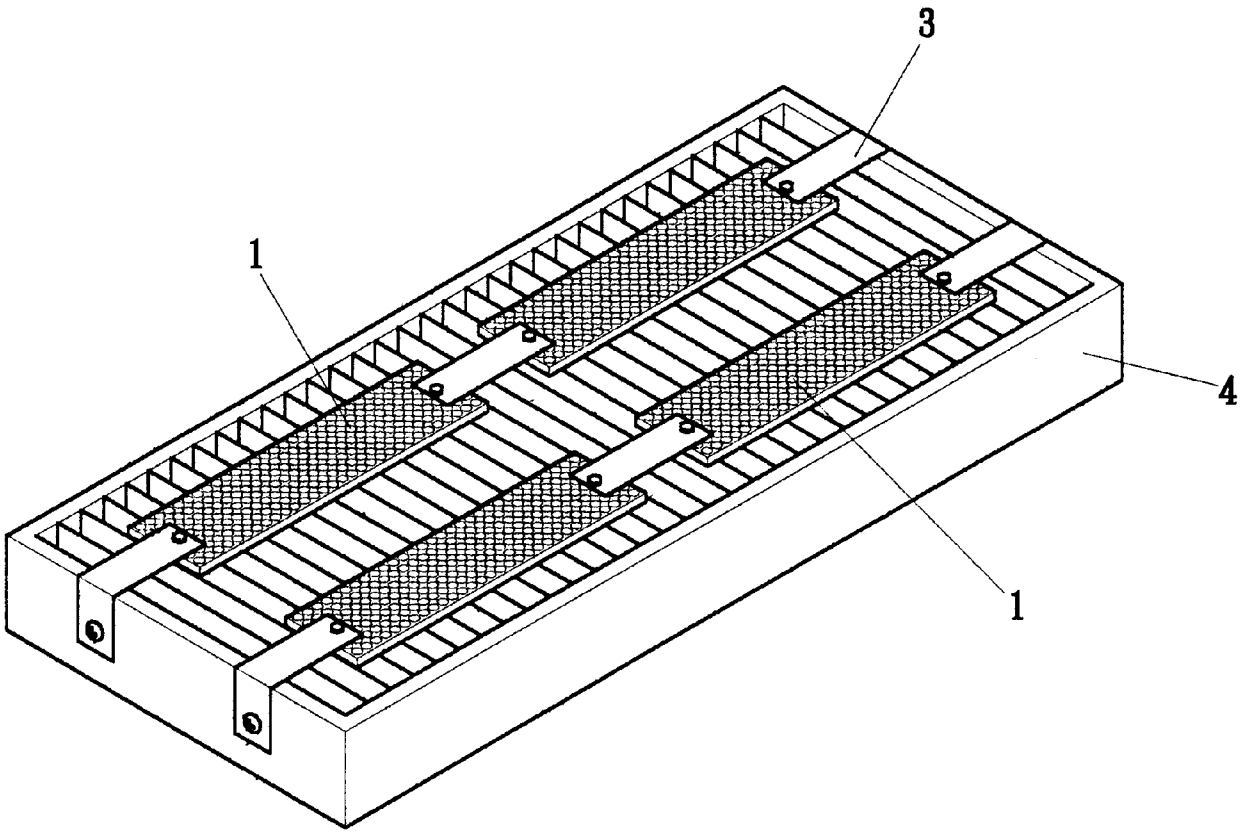
FIG. 4 is a perspective view of a first preferred embodiment of the present invention.
Figure 5B:
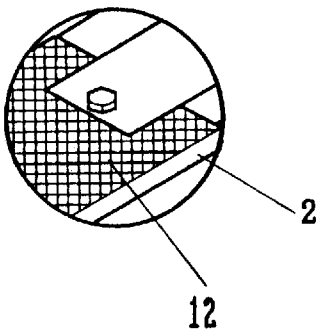
FIG. 5(B) is an enlarged view of the circle of FIG. 5(A)
Figure 5A:
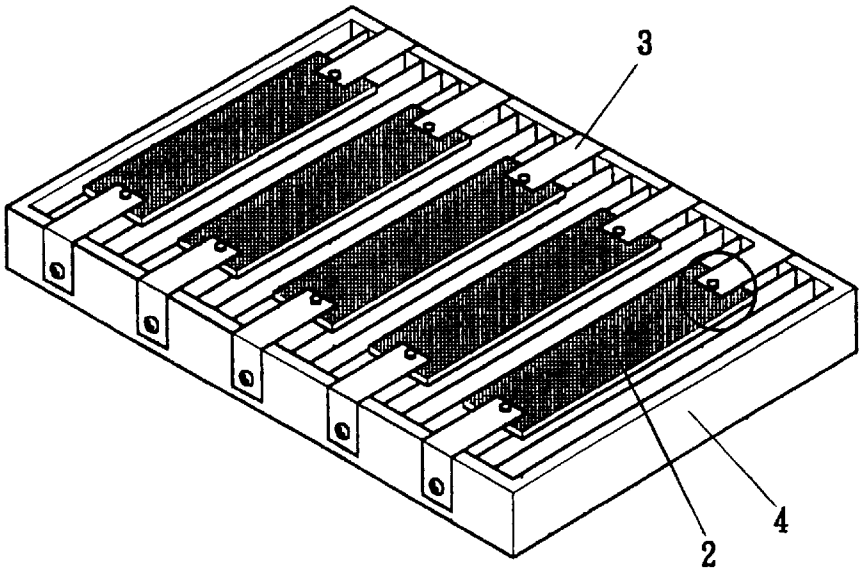
FIG. 5A is a perspective view of a second preferred embodiment of the present invention.
Figure 6:
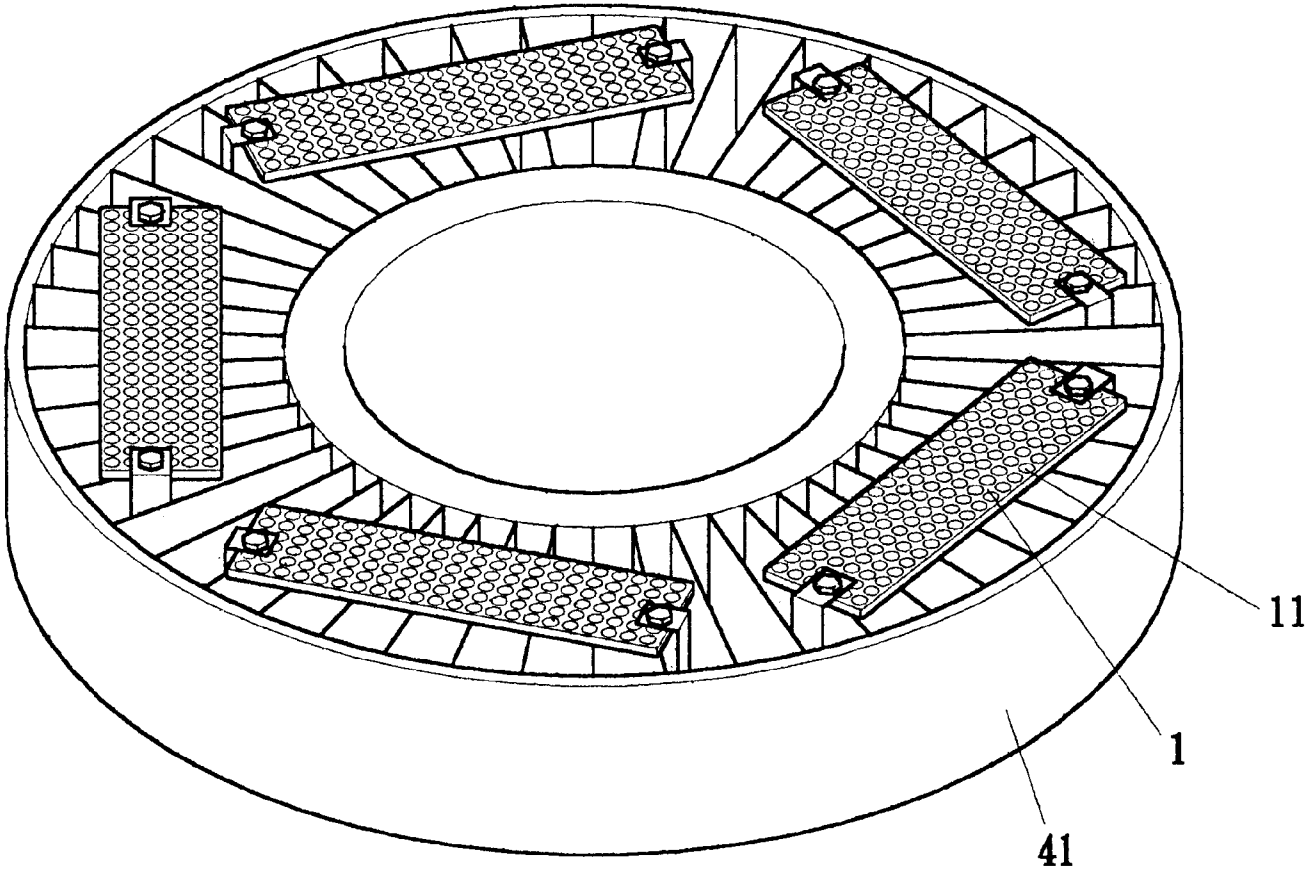
FIG. 6 is a perspective view of a third preferred embodiment of the present invention.
Figure 7:
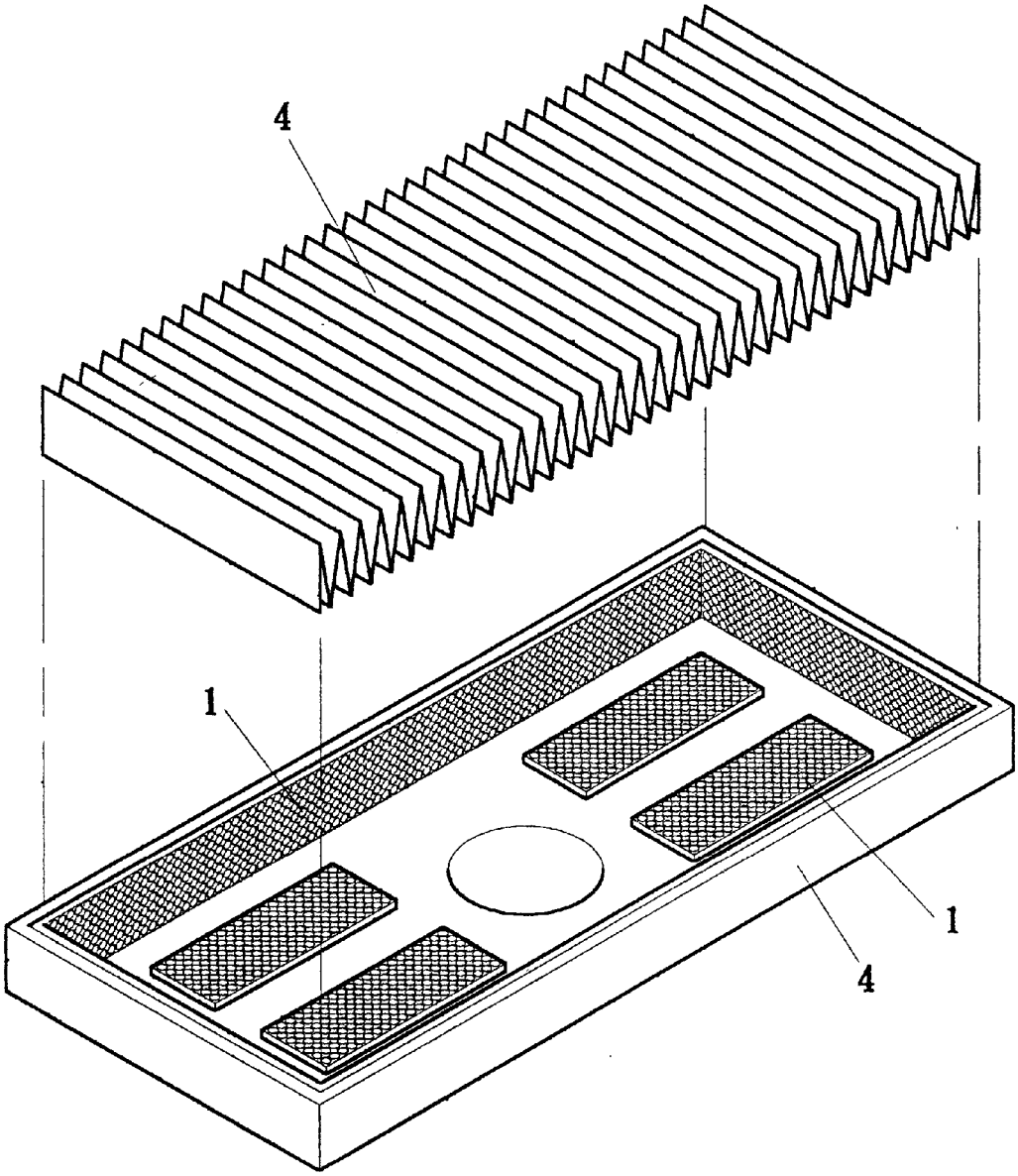
FIG. 7 is a perspective view of a fourth preferred embodiment of the present invention.

FIG. 3 is an exploded perspective view of the energy emitter cooperating with a flexible locating member in accordance with the present invention. In the application of the present invention, a plurality of flexible locating members 3 can be connected to the sides of the energy emitters 1 which are fitted at certain positions of the filter element by strip-shaped flexible locating members 3.

Figure 8:
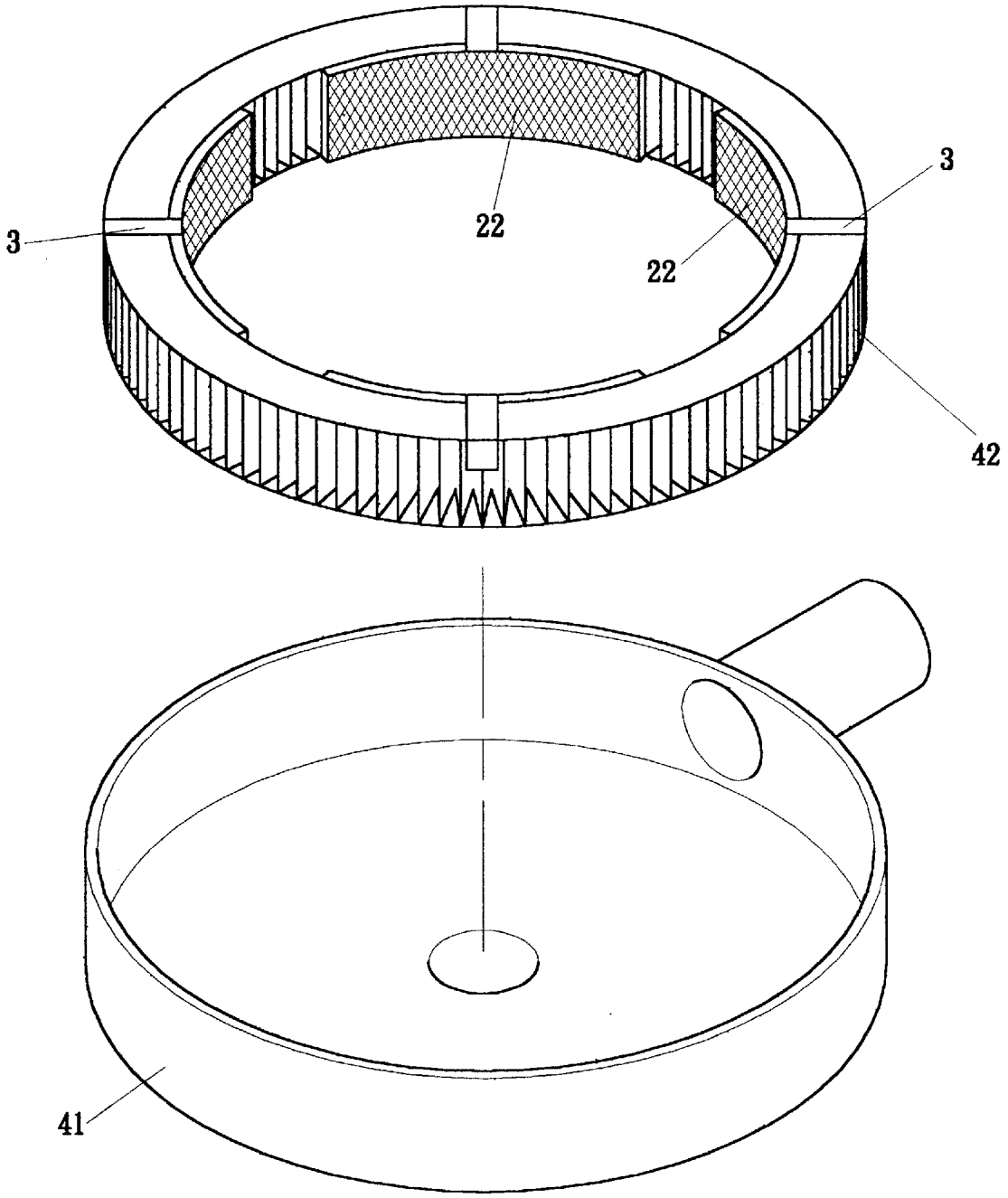
FIG. 8 is a perspective view of a fifth preferred embodiment of the present invention.
Figure 9:
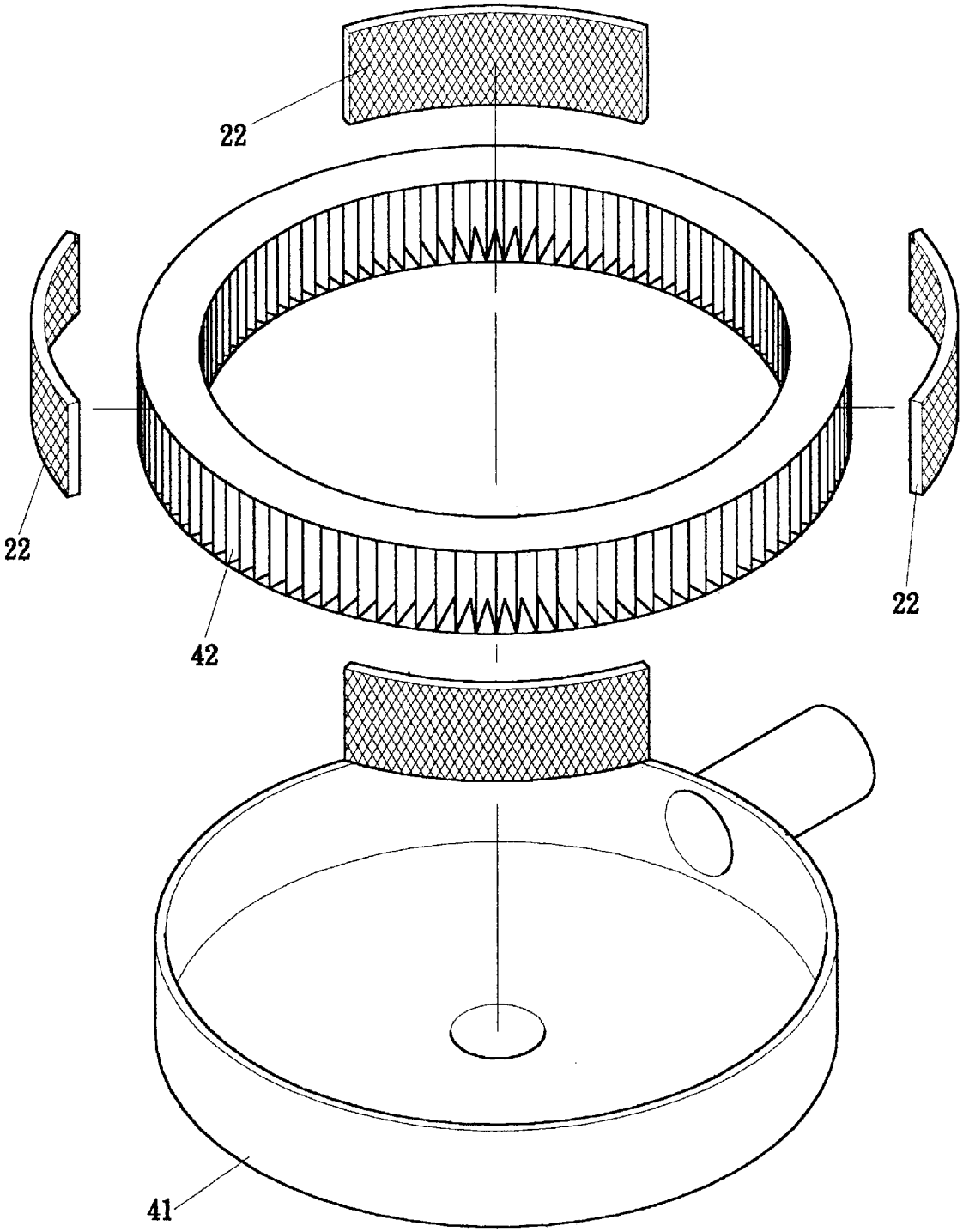
FIG. 9 is an exploded view of a sixth preferred embodiment of the present invention.

FIGS. 4, 5, 6, 7, 8 and 9 show preferred embodiments of the present invention respectively, wherein FIGS. 4, 5, 6 and 7 illustrate an air filter for a jet engine and FIGS. 8 and 9 illustrate air filter for an engine wit ha carburetor. The fastening of the energy emitters 1, 2, 22 on the air filter elements 4, 41, 42 by means of the flexible locating member 3 can be arranged in different ways. A large sufficient contact area can be achieved by means such that the energy emitter 1, 2, 22 are properly fitted to the air filter elements 4, 41, 42 and the passing air flow simultaneously passes through each guide hole 11, 12. In addition, the energy emitters 1, 2, 22 themselves can emit far infrared rays (or electromagnetic field) of appropriate amount. Within the energy emission range the cluster of water, molecules in the air can be made smaller and smaller to increase the contact surface area of the compressed air to fully enhance the activity of the fuel and the compressed air in order to achieve better combustion efficiency. After the fuel (gasoline, diesel, gas etc.) is more completely consumed in combustion, the exhaust (e.g. carbon monoxide, hydrocarbon, nitrogen oxide, sulfide etc.) from the engine can be considerably diminished and the pollution will also be reduced. Moreover, when the carbon deposit is reduced in the engine since the gasoline is combusted more completely, the friction in the engine will be reduced, increasing and the engine working power with be smoother during, due to the high stability of parts the life cycle of mechanical parts of vehicle will be fuel extended consumption reduced.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A power activating device comprising:

at least one infrared ray energy emitter that emits far infrared rays and is comprised of at least one compound material comprising air passages therethrough, the at least one energy emitter positioned on an air filter of an internal combustion engine;

the at least one infrared ray energy emitter emits a specific amount of energy; and a plurality of parallel guide holes that extend through said energy emitter in order to permit a smooth air flow therethrough and enlarge contact surface area between the at least one energy emitter and air passing therethrough such that the energy given off by said at least one energy emitter exerts a full effect on the air running therethrough.

2. The power activating device as claimed in claim 1, wherein said infrared ray energy emitter is made of the ceramic, metallic and polymer material respectively mixed in accordance with different proportion thereof.

3. The power activating device as claimed in claim 1, wherein said energy emitter is made of the ceramic and metallic material mixed in accordance with preset proportion thereof.

4. The power activating device as claimed in claim 1, wherein said energy emitter is made of the ceramic and polymer material mixed in accordance with preset proportion thereof.

5. The power activating device as claimed in claim 1, wherein said energy emitter is made of the metallic and polymer material mixed in accordance with preset proportion thereof.

6. The power activating device as claimed in claim 1, wherein said energy emitter of far infrared rays is made of a ceramic, metallic and polymer material according with preset proportion thereof.

7. The power activating device as claimed in claim 1, wherein said energy emitter gives off energy in the form of an electromagnetic field.

8. The power activating device as claimed in claim 1, wherein said energy emitter gives off energy in the form of an electromagnetic field and is made of a ceramic material.

9. The power activating device as claimed in claim 1, wherein said energy emitter gives off energy in the form of an of electromagnetic field and is made of a metal material.

10. The power activating device as claimed in claim 1, wherein the cluster of water molecules in the compressed air passing through the energy emitter is reduced by said energy emitter within a preset range.

11. The power activating device as claimed in claim 1, wherein said energy emitter has different shapes and thickness.

12. The power activating device as claimed in claim 1, wherein said energy emitter is a square plate body.

13. The power activating device as claimed in claim 1, wherein guide holes in said energy emitter can be formed in different shapes in section.

14. The power activating device as claimed in claim 2, wherein said energy emitter of far infrared rays is made of a ceramic, metallic and polymer material according with preset proportion thereof.

* * * * *